US009045947B2

(12) United States Patent
Edwards et al.

(10) Patent No.: US 9,045,947 B2
(45) Date of Patent: Jun. 2, 2015

(54) SUBSEA WINCH

(75) Inventors: Jeffrey Charles Edwards, Aberdeenshire (GB); Michael Graham Morgan, Aberdeenshire (GB)

(73) Assignee: ENOVATE SYSTEMS LIMITED, Aberdeen (GB)

( * ) Notice: Subject to any disclaimer, the term of this patent is extended or adjusted under 35 U.S.C. 154(b) by 659 days.

(21) Appl. No.: 13/319,778

(22) PCT Filed: May 13, 2010

(86) PCT No.: PCT/GB2010/000971

§ 371 (c)(1), (2), (4) Date: Mar. 26, 2012

(87) PCT Pub. No.: WO2010/131010

PCT Pub. Date: Nov. 18, 2010

(65) Prior Publication Data

US 2012/0181038 A1 Jul. 19, 2012

(30) Foreign Application Priority Data

May 14, 2009 (GB) ..... 0908279.3

(51) Int. Cl.

| | |
|---|---|
| ***E21B 41/04*** | (2006.01) |
| ***E21B 19/00*** | (2006.01) |
| ***B66D 1/74*** | (2006.01) |
| ***E21B 33/076*** | (2006.01) |

(52) U.S. Cl.

CPC ..... *E21B 19/008* (2013.01); *B66D 1/7405* (2013.01); *E21B 33/076* (2013.01)

(58) Field of Classification Search

CPC ..... E21B 19/008; B66D 1/7405

USPC ..... 166/335, 338, 341, 343, 350, 351, 355, 166/385, 77.1, 242.2; 254/278, 289, 290

See application file for complete search history.

(56) References Cited

U.S. PATENT DOCUMENTS

| | | | | | |
|---|---|---|---|---|---|
| 2,262,364 | A | * | 11/1941 | Hugel et al. | 166/77.1 |
| 2,630,180 | A | * | 3/1953 | Summers | 166/77.1 |
| 2,677,427 | A | * | 5/1954 | McKinney et al. | 166/77.1 |

(Continued)

FOREIGN PATENT DOCUMENTS

| | | | |
|---|---|---|---|
| CN | 1683232 | A | 10/2005 |
| GB | 2 104 601 | A | 3/1983 |

(Continued)

OTHER PUBLICATIONS

Chinese Office Action dated Jan. 28, 2014.

*Primary Examiner* — James G Sayre

(74) *Attorney, Agent, or Firm* — Tarolli, Sundheim, Covell & Tummino LLP

(57) ABSTRACT

A subsea winch is described. The subsea winch comprises a housing adapted to be attached to a well intervention system, the housing having an inlet and an outlet and at least one powered sheave arranged between the inlet and the outlet, the or each powered sheave having a surface adapted to form a frictional engagement with a cable passing between the inlet and the outlet via the at least one sheave. In use, a pull force pulling the cable in a downhole direction applied to the cable by a tool string being lowered into the well intervention system is increased by the winch such that the downhole pull force on the cable at the housing inlet is greater than the downhole pull force at the housing outlet.

28 Claims, 4 Drawing Sheets

(56) References Cited

U.S. PATENT DOCUMENTS

| | | | | | |
|---|---|---|---|---|---|
| 2,693,858 | A | | 11/1954 | Osmun | |
| 2,720,266 | A | * | 10/1955 | Broussard et al. | 166/77.1 |
| 3,044,723 | A | * | 7/1962 | Blue | 242/364.11 |
| 3,568,767 | A | * | 3/1971 | Weiss | 166/351 |
| 3,666,239 | A | * | 5/1972 | Koshihara | 254/287 |
| 4,515,211 | A | * | 5/1985 | Reed et al. | 166/77.1 |
| 4,607,693 | A | * | 8/1986 | Richardson | 166/65.1 |
| 6,089,547 | A | * | 7/2000 | Juelich et al. | 254/329 |
| 8,091,629 | B2 | * | 1/2012 | Fogg et al. | 166/77.1 |
| 2011/0147684 | A1 | * | 6/2011 | Roodenburg et al. | 254/297 |
| 2012/0181038 | A1 | | 7/2012 | Edwards et al. | |

FOREIGN PATENT DOCUMENTS

| | | | | | |
|---|---|---|---|---|---|
| GB | 2 104 601 | B | | 7/1985 | |
| GB | 2484106 | A | * | 9/2010 | F18H 7/04 |
| WO | WO 01/61145 | A1 | | 8/2001 | |
| WO | WO 0161145 | A1 | * | 8/2001 | E21B 33/076 |

* cited by examiner

SUBSEA WINCH

FIELD OF THE INVENTION

The present invention relates to a subsea winch, particularly but not exclusively to a winch for raising and lowering a tool into a wellbore.

BACKGROUND TO THE INVENTION

Deployment systems, such as wireline, for deploying tools in oil wells are widely used. In operation, a wireline deployment system runs a wireline cable from a surface vessel down to a subsea wellhead. The subsea wellhead comprises a BOP package on the seabed, a lubricator system attached to the BOP and a stuffing box through which the wireline cable passes to access the lubricator system. Tools are connected or disconnected from the end of the wireline cable in the lubricator system, and once ready for downhole operations, the well is opened up and the wireline, complete with tools, is lowered in.

The combined weight of the tools is generally sufficient to allow for progression of the tool down the well. In deviated wells a tractor maybe used to assist in progression of the tools down the well. In either case, the weight of the tools and/or the action of the tractor applies a downward pull force to the wireline.

This arrangement works well at depths of 500 meters or less. At these depths, the wireline cable will enter the stuffing box in a substantially vertical orientation, that is when the cable enters the well it is substantially aligned with the entrance to the well. However at depths greater than 500 meters the effects of currents can drag the wireline cable into a more curved or caternary shape, with the result that the angle of entry into the well becomes closer to horizontal.

In this orientation there is a greater frictional resistance between the cable and the subsea apparatus. Furthermore, the drag of the current can apply an upward pull on the wireline, countering the effects of the downward pull force applied to the wireline by gravity and/or the action of the tractor. In extreme cases the drag-induced upward pull and/or the frictional resistance loading applied to the wireline is so great that it overcomes the downward pull force preventing the wireline tools from descending into the well.

SUMMARY OF THE INVENTION

According to a first aspect of the present invention there is provided a subsea winch comprising:

a housing adapted to be attached to a well intervention system, the housing having an inlet and an outlet; and at least one powered sheave arranged between the inlet and the outlet, the or each powered sheave having a surface adapted to form a frictional engagement with a cable passing between the inlet and the outlet via the at least one sheave;

wherein, in use, a pull force pulling the cable in a downhole direction applied to the cable by a tool string being lowered into the well intervention system is increased by the winch such that the downhole pull force on the cable at the housing inlet is greater than the downhole pull force at the housing outlet.

In one embodiment, the subsea winch acts as a friction drive and allows, in use, the tool to progress down the well without being hindered by any loading which is applied to the cable by currents or frictional resistance loading due to interaction with the housing inlet. By utilising a friction drive, the tension applied to the cable due to the weight of the tool or the pull of the tool (if the tool includes, for example, a down hole tractor) is increased by the winch sufficiently to at least partially overcome any tension on the cable at the housing inlet, which would otherwise act against the progress of the tool down the well.

In one embodiment the inlet comprises a stuffing box.

In an embodiment the inlet comprises a funnel.

The inlet may be moveable with respect to a housing body. In one embodiment, providing a moveable inlet allows the inlet to be aligned with or towards the direction of the incoming cable, in use, thereby smoothing the angle of entry of the wireline cable into the housing body and decreasing the frictional resistance which may otherwise exist between the housing inlet and the incoming cable.

The inlet may be self-aligning, in use, with an incoming cable,

The inlet may be rotatably mounted to the housing body.

The inlet may be rotatably mounted to the housing body by means of a universal joint. A universal joint facilitates movement of the inlet to self-align regardless of the direction the wireline cable is being pulled by the prevailing currents.

Alternatively or additionally, the inlet may comprise a flexible portion. A flexible portion may permit the inlet to bend under the influence of the incoming cable reducing friction between the cable and the housing inlet.

The housing inlet may comprise a low fiction material and/or a low friction coating.

The housing inlet may comprise a low friction mechanism such as rollers or ball bearings.

Where the housing inlet is flexible the inlet may comprise wear resistant elements.

Where there is one or more sheaves, a first sheave is located adjacent a well axis.

In one embodiment there are a plurality of sheaves.

In a preferred embodiment there are two sheaves.

In the preferred embodiment where there is a first sheave and a second sheave, the first sheave is arranged between the second sheave and the well axis. The well axis is the centreline of the well bore.

The housing outlet may be aligned with the well axis.

The housing inlet and the housing exit may not be aligned.

The housing inlet axis may be different to the well axis.

The housing inlet axis may be parallel to the well axis.

The or each sheave may define at least one groove.

The or each sheave may comprise a plurality of grooves.

Alternatively the or each sheave may define a continuous groove defining a number of turns.

The continuous groove may define at least 2.5 turns.

The or each groove may define multiple turns.

The first sheave may be arranged such that a groove is aligned with the housing inlet axis.

The first sheave may be arranged such that a different groove is aligned with the housing outlet axis.

The first sheave and the housing inlet may be arranged such that the housing inlet axis and the housing outlet axis are tangential to the first sheave.

The first sheave may be arranged, in use, to receive the cable from the housing inlet and deliver the cable to the housing outlet.

The subsea winch may comprise a guide for feeding, in use, the incoming cable from the housing inlet onto the first sheave.

In one embodiment, the or each sheave is adapted to rotate on a shaft.

The or each shaft may define an axis, the or each axis may be perpendicular to, but not intersecting with, the well axis.

The second sheave may be at an angle to the first sheave. Where there are first and second sheaves, the cable will pass from a first sheave first groove to a second sheave first groove. The cable will then turn through 180 degrees around the second sheave and pass back to the first sheave. Having the second sheave at an angle to the vertical or to the first sheave ensures that when the cable leaves the first groove on the second sheave it passes on to a second groove on the first sheave.

In one embodiment there are a plurality of sheaves.

In one embodiment a plurality of the sheaves are powered.

In a preferred embodiment all the sheaves are powered.

The or each sheave may be powered by a motor.

The motor(s) may be hydraulic.

Alternatively the motor(s) may be electric powered or air powered.

The motor(s) may be powered from surface, from a subsea power unit, a remotely operated vehicle, battery pack or any suitable power source.

In an embodiment where there are a plurality of sheaves, the motor(s) may operate independently. It is believed having each sheave driven independently by a discrete motor enhances the performance of the subsea winch and minimises the opportunities to damage the cable.

In an alternative embodiment the motors are synchronised.

The motor(s) may comprise a braking system.

The or each sheave may be dish shaped. A dish- or bowl-shaped sheave weighs less than a disc of material.

Alternatively the sheaves may be flat.

According to a second aspect of the present invention there is provided a stuffing box for use with a subsea wellhead, the stuffing box comprising:

a housing adapted to be connected to a well intervention system, the housing having a body, an inlet and an outlet, the inlet being movable with respect to the housing body.

According to a third aspect of the present invention there is provided a method of intervening in a well, the method comprising the step of:

lowering a tool into a well, the tool being attached to a cable, the cable passing into the well via at least one subsea winch powered sheave and forming a frictional engagement with the at least one powered winch surface.

BRIEF DESCRIPTION OF THE DRAWINGS

An embodiment of the invention will now be described with reference to the accompanying drawings in which:

FIG. 4, comprising

DETAILED DESCRIPTION OF THE DRAWINGS

Figure 1:
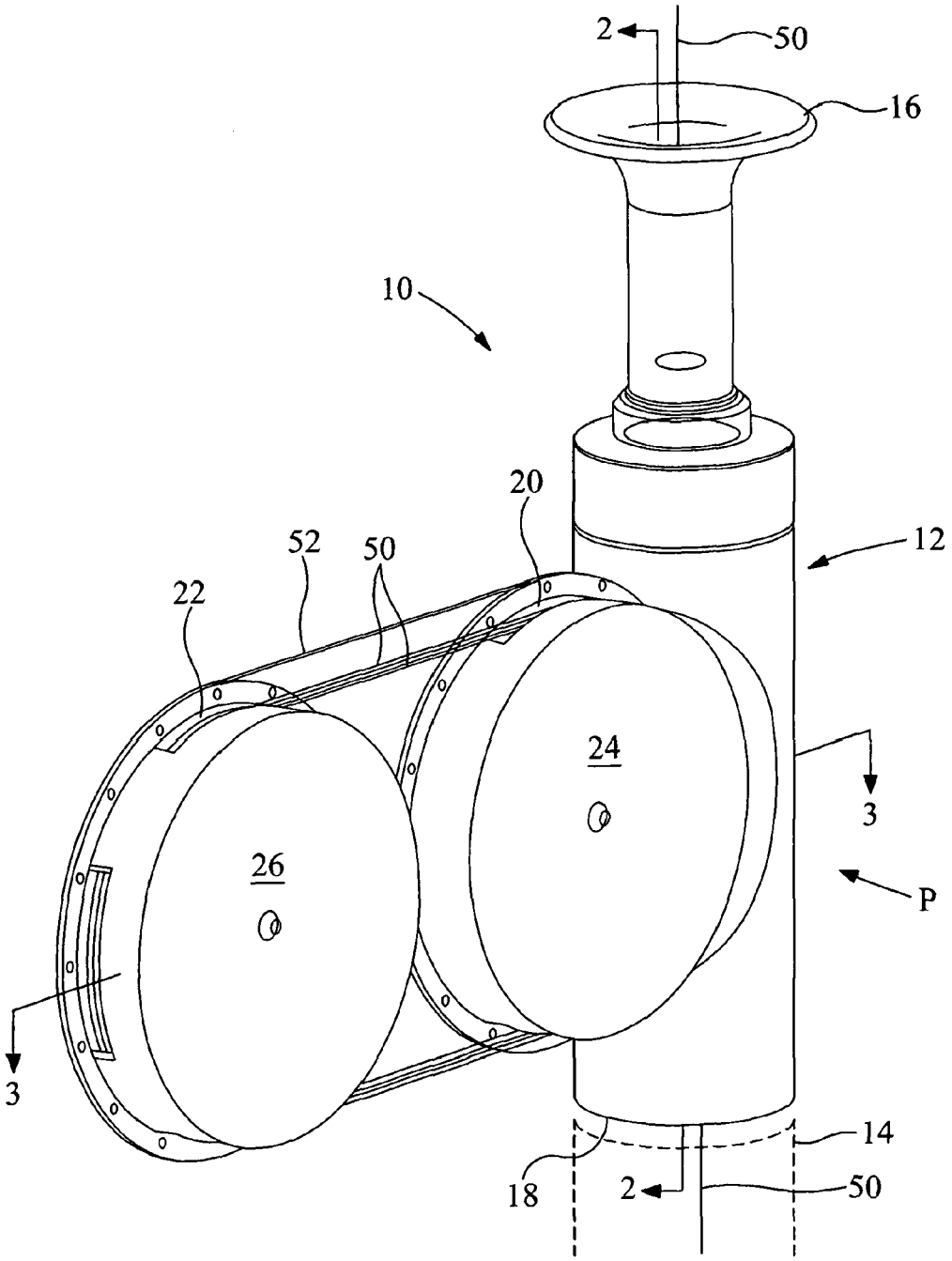
FIG. 1 is a perspective view of a subsea winch according to a first embodiment of the present invention.

Referring firstly to FIG. 1 there is shown a subsea winch, generally indicated by reference numeral 10, according to an embodiment of the present invention. The subsea winch 10 comprises a housing 12, the housing 12 performs the function of a stuffing box and is attached to a well intervention system 14. The well intervention system 14 includes a lubricator section, the upper part of which can be seen in broken outline on FIG. 1, and a BOP on the seabed (not shown).

The housing 12 has an inlet 16, in the form of a funnel, and an outlet 18. The subsea winch 10 further comprises first and second powered sheaves 20, 22. The sheaves 20, 22 are mounted to a supporting plate 52 and are protected by first and second casings 24, 26 respectively. The sheaves 20,22 will be discussed and shown in detail later.

The apparatus 10 is adapted to receive a wireline cable 50 which is to be used to lower a tool (not shown) through the well intervention system 14 into the well. The wireline cable 50 enters the apparatus 10 through the inlet 16, forms a frictional engagement with the first and second sheaves 20, 22 and enters the well intervention system 14 through the winch outlet 18. The operation and purpose of the winch 10 will be described in due course.

Figure 2:
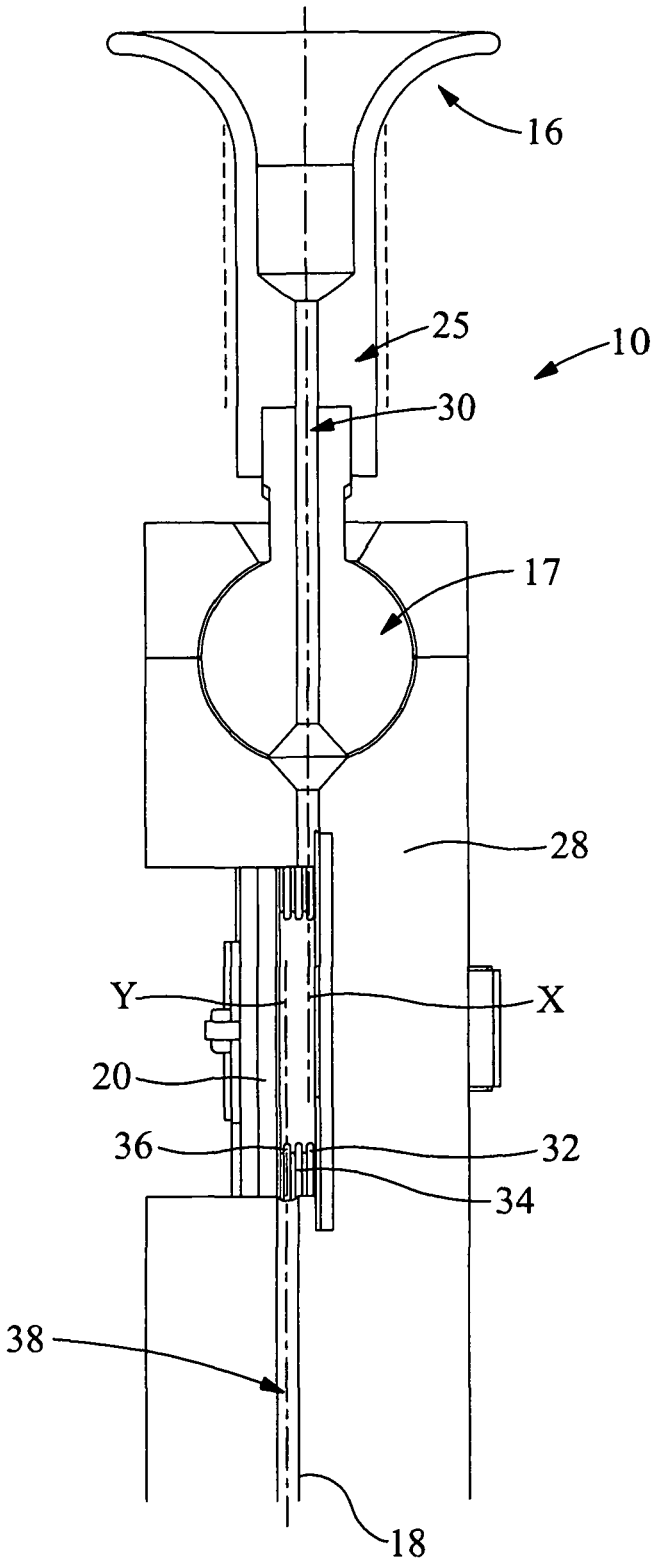
FIG. 2 is a vertical sectional view taken on line 2-2 on FIG. 1 at the wireline centre of the subsea winch of FIG. 1.

Reference is now made to FIG. 2, a vertical sectional view taken on line 2-2 on FIG. 1 at the wireline centre of the apparatus 10 of FIG. 1. The inlet 16 comprises a funnel 25 connected to a housing body 28 by a universal joint 27, the funnel 25 being able to rotate with respect to the housing body 28 by rotation of the universal joint 27. The provision of a universal joint 27 allows the inlet 16 to manoeuvre to receive an incoming wireline cable, which may not be in line with the inlet vertical axis 30. Such manoeuvrability reduces the friction experienced between the cable 50 and the housing 12 compared to the friction experienced between a conventional fixed inlet and an incoming cable 50 at the same angle.

The first sheave 20 comprises a first groove 32, a second groove 34 and a third groove 36. The first groove 32 is aligned with the inlet axis 30 such that when the cable 50 is fed through the inlet 16 the cable 50 engages with the first sheave first groove 32. Similarly, the first sheave third groove 36 is aligned with the outlet axis 38 such that when the cable 50 leaves the first sheave 36 it can pass through the outlet 18 into the well intervention system 14. The outlet axis 38 coincides with the wellbore axis (not shown).

Figure 3:
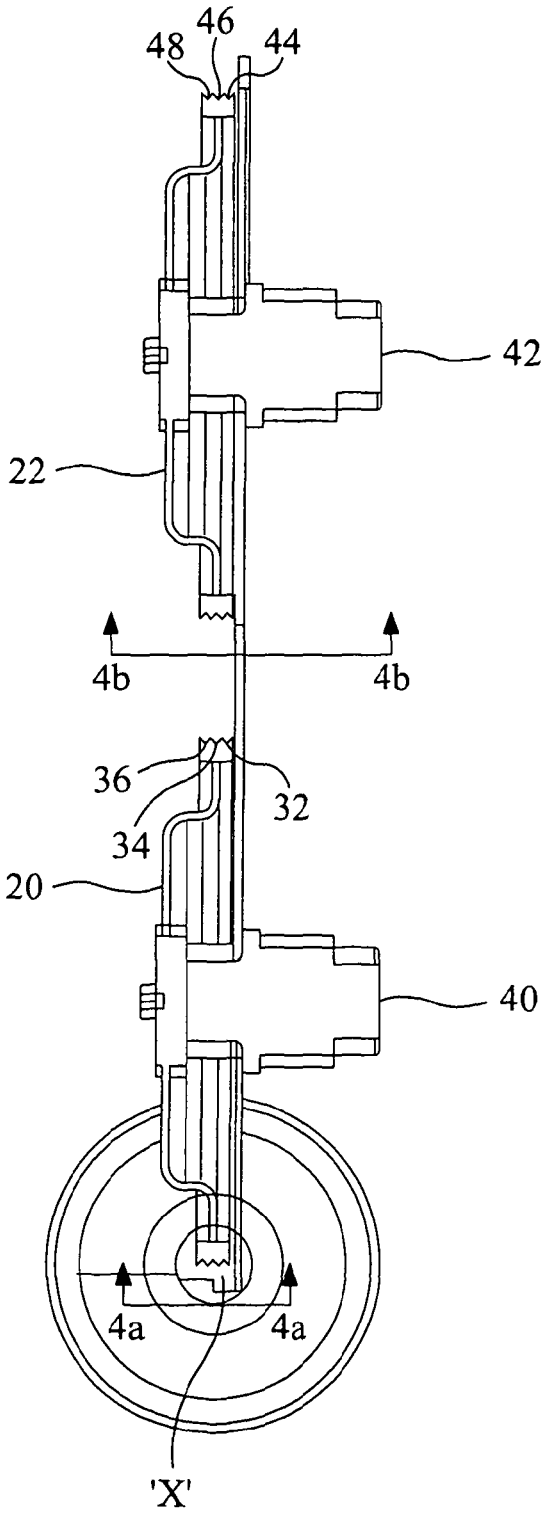
FIG. 3 is a transverse sectional view taken on line 3-3 on FIG. 1 of the subsea winch of FIG. 1.

Referring to FIG. 3, a transverse sectional view through the subsea winch 10 of FIG. 1 taken on line 3-3 of FIG. 1, the first and second sheaves 20, 22 can be seen. The sheaves 20, 22 are circular and bowl shaped and are powered by first and second hydraulic motors 40, 42 respectively. The hydraulic motors 40,42 are powered by a hydraulic fluid supply (not shown) from a subsea hydraulic power unit (not shown).

The second sheave 22 also comprises first, second and third grooves 44, 46 and 48. From FIG. 3 it will be seen that the second sheave 22 is at an angle to the vertical such that the lowest point of the sheave 22 (directly beneath the motor 42) is closer to the sheave supporting plate 52 than the rest of the sheave 22.

Figure 4A:
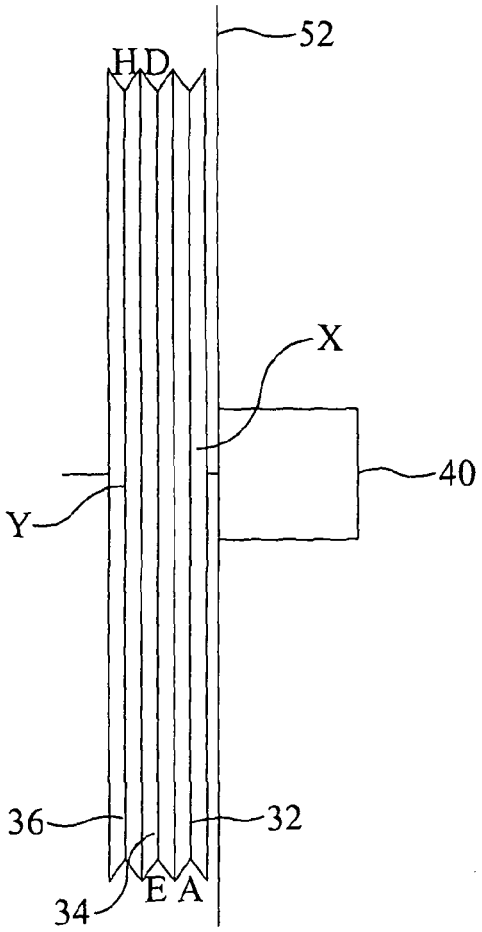
FIG. 4*a* and FIG. 4*b*, are end views of the first and second sheaves respectively taken on lines 4*a*-4*a* and 4*b*-4*b* on FIG. 3 respectively.
Figure 4B:
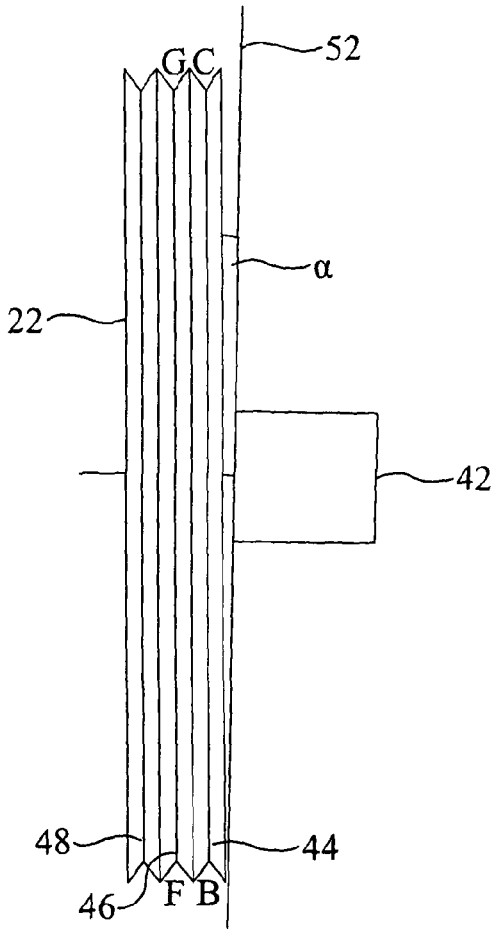

The arrangement of the sheaves 20, 22 with respect to the supporting plate 52 can also be seen from FIG. 4. FIG. 4 comprises FIGS. 4*a* and 4*b*, FIG. 4*a* being a side view of the first sheave 20 taken along line 4*a*-4*a* on FIG. 3 and FIG. 4*b* being a side view of the second sheave 22 taken along line 4*b*-4*b* on FIG. 3. The first sheave 20 (FIG. 4*a*) is shown parallel to the supporting plate 52, whereas the second sheave 22 (FIG. 4*b*) is shown at an angle $\propto$ to the supporting plate 52.

The operation of the winch 10 will now be described with reference to FIGS. 2, 3 and 4. The cable 50 passes down through the subsea winch 10, to engage the first sheave first groove 32 at the point marked "X" on FIGS. 2 and 4*a*. The cable 50 is fed onto the first sheave first groove 32 by a guide (not shown).

The cable 50 forms a frictional engagement with the sheave 20 and is turned through 90 degrees before leaving the first sheave 20 at the point marked "A" on FIG. 4*a* and passing to the second sheave first groove 44 at the point marked "B" on FIG. 4*b*. The cable 50 is then turned 180 degrees clockwise as viewed from position "P" on FIG. 1 by the second sheave 22 to leave the second sheave first groove 44 at the top of the second sheave 22, at the point marked "C" on FIG. 4*b*, to join the first sheave second groove 34 at the point marked "D" on FIG. 4*a*. As the second sheave 22 is at an angle ∝ to the vertical, the second sheave first groove 44, at the point marked "C" on FIG. 4*b*, is aligned with the first sheave second groove 34 at the point marked "D" on FIG. 4*a*, that is at the point where the cable 50 leaves the second sheave 22 to return to the first sheave 20. Angling the second sheave 22 with respect to the first sheave 20 by an angle ∝ gives a quasi helix across the two sheaves 20,22.

The cable 50 goes through another 180 degree turn on the first sheave second groove 34 to the point marked "E" on FIG. 4*a*, before passing to the second sheave second groove 46, at the point marked "F" on FIG. 4*b*, for a further 180 degree turn. When the cable 50 reaches point "G" on FIG. 4*b*, the cable 50 returns to join the first sheave third groove 36 at the point marked "H" on FIG. 4*a*.

The cable 50 is carried a through a further 90 degree turn before being leaving the first sheave 22 at the point marked "Y" on FIGS. 2 and 4*a* and exiting the subsea winch 10 through the outlet 18.

The frictional engagement between the cable 50 and the sheaves 20,22 means that a tension applied by the tool (not shown) to the cable 50 to pull the cable 50 down the well is increased by the powered sheaves 20,22 and results in an increased tension pulling the cable 50 into the winch 10 though the inlet 16, to at least partially overcome a tidal force which is trying to pull the cable 50 out of the apparatus 10.

Various modifications and improvements may be made to the above-described embodiment without departing from the scope of the invention. For example, in an alternative embodiment, there may only be a single sheave with a continuous groove or, in a further alternative embodiment, only one of the sheaves may be powered.

The invention claimed is:

1. A subsea winch comprising:

a housing adapted to be attached to a well intervention system, the housing having an inlet and an outlet; and a plurality of powered sheaves arranged between the inlet and the outlet, each powered sheave having a surface adapted to form a frictional engagement with a cable passing between the inlet and the outlet via the plurality of sheaves, the plurality of sheaves including a first sheave and a second sheave, the first sheave being located adjacent a well axis, the well axis being defined as a centerline of a well bore, the first sheave being arranged between the second sheave and the well axis;

wherein, in use, a pull force pulling the cable in a downhole direction applied to the cable by a tool string being lowered into the well intervention system is increased by the winch such that the downhole pull force on the cable at the housing inlet is greater than the downhole pull force at the housing outlet.

2. The subsea winch of claim 1, wherein the inlet comprises a stuffing box.

3. The subsea winch of claim 1, wherein the inlet comprises a funnel.

4. The subsea winch of claim 1, wherein the inlet is moveable with respect to a housing body.

5. The subsea winch of claim 4, wherein the inlet is self-aligning, in use, with an incoming cable.

6. The subsea winch of claim 4, wherein the inlet is rotatably mounted to the housing body.

7. The subsea winch of claim 6, wherein the inlet is rotatably mounted to the housing body by means of a universal joint.

8. The subsea winch of claim 1, wherein there are two sheaves.

9. The subsea winch of claim 1, wherein the housing outlet is aligned with the well axis.

10. The subsea winch of claim 1, wherein each sheave defines at least one groove.

11. The subsea winch of claim 10, wherein each sheave comprises a plurality of grooves.

12. The subsea winch of claim 11, wherein each groove defines multiple turns.

13. The subsea winch of claim 10, wherein each sheave defines a continuous groove defining a number of turns.

14. The subsea winch of claim 13, wherein the continuous groove defines at least 2.5 turns.

15. The subsea winch of claim 1, wherein the first sheave is arranged such that a groove is aligned with the housing inlet axis.

16. The subsea winch of claim 15, wherein the first sheave is arranged such that a different groove is aligned with the housing outlet axis.

17. The subsea winch of claim 16, wherein the first sheave and the housing inlet are arranged such that the housing inlet axis and the housing outlet axis are tangential to the first sheave.

18. The subsea winch of claim 17, wherein the first sheave is arranged, in use, to receive the cable from the housing inlet and deliver the cable to the housing outlet.

19. The subsea winch of claim 1, wherein the subsea winch comprises a guide for feeding, in use, the incoming cable from the housing inlet onto the first sheave.

20. The subsea winch of claim 1, wherein the second sheave is at an angle to the first sheave.

21. The subsea winch of claim 1, wherein each sheave is independently powered by a discrete motor.

22. The subsea winch of claim 21, wherein the motors are hydraulic.

23. The subsea winch of claim 1, wherein the motors are electric powered or air powered.

24. The subsea winch of claim 21, wherein the motors are synchronized.

25. The subsea winch of claim 21, wherein the motors comprise a braking system.

26. The subsea winch of claim 1, wherein the sheaves are dish shaped.

27. The subsea winch of claim 1, wherein the sheaves are flat.

28. A method of intervening in a well, the method comprising the step of:

lowering a tool into a well, the tool being attached to a cable, the cable passing into the well via at least one subsea winch comprising a housing adapted to be attached to a well intervention system, the housing having an inlet and an outlet; and a plurality of powered sheaves arranged between the inlet and the outlet, each powered sheave having a surface adapted to form a frictional engagement with the cable passing between the inlet and the outlet via the plurality of sheaves, wherein the plurality of sheaves comprises a first sheave and a second sheave, the first sheave being located adjacent a well axis, the well axis being defined as a centerline of a well bore, the first sheave being arranged between the second sheave and the well axis; wherein, in use, a pull force pulling the cable in a downhole direction applied to the cable by a tool string being lowered into the well intervention system is increased by the winch such that the downhole pull force on the cable at the housing inlet is greater than the downhole pull force at the housing outlet.

* * * * *